United States Patent [19]

Levinson et al.

[11] 4,269,522

[45] May 26, 1981

[54] BI-DIRECTIONAL RECORD MATERIAL FEED APPARATUS

[75] Inventors: Leo Levinson, Berkley; William D. Rempel, San Mateo, both of Calif.

[73] Assignee: Xerox Corporation, Stamford, Conn.

[21] Appl. No.: 917,233

[22] Filed: Jun. 20, 1978

[51] Int. Cl.[3] ..... B41J 15/00

[52] U.S. Cl. ..... 400/616.1; 400/551; 400/616.3; 400/636.2

[58] Field of Search ..... 400/551, 569, 616, 616.1, 400/616.2, 616.3, 636.2, 639.1; 226/74, 75, 76, 77, 78, 79, 80, 81, 82, 83, 84, 85, 86, 87

[56] References Cited

U.S. PATENT DOCUMENTS

| | | | |
|---|---|---|---|
| 2,047,233 | 7/1936 | Sherman | 400/616.3 |
| 2,277,156 | 3/1942 | Sherman et al. | 400/616.3 |
| 2,355,668 | 8/1944 | Morse | 400/616 |
| 3,154,235 | 10/1964 | Hubbard | 400/616 X |
| 3,444,977 | 5/1969 | Kinney et al. | 400/616.1 X |
| 3,625,333 | 12/1971 | Cortona et al. | 400/639.1 X |
| 3,746,142 | 7/1973 | Hepp et al. | 400/616.3 X |
| 3,753,483 | 8/1973 | Lundquist et al. | 400/616.1 X |
| 3,880,016 | 4/1975 | Jamieson et al. | 400/569 X |
| 4,033,493 | 7/1977 | Levinson | 226/81 |
| 4,042,091 | 8/1977 | Levinson et al. | 400/616.1 |

FOREIGN PATENT DOCUMENTS

| | | | |
|---|---|---|---|
| 155578 | 3/1954 | Australia | 400/616.2 |
| 789605 | 1/1958 | United Kingdom | 400/616.1 |
| 802676 | 10/1958 | United Kingdom | 400/616.1 |
| 848918 | 9/1960 | United Kingdom | 400/616.2 |
| 1366027 | 9/1974 | United Kingdom | 400/616.1 |
| 1494607 | 12/1977 | United Kingdom | 400/551 |

OTHER PUBLICATIONS

IBM Technical Disclosure Bulletin, "Bidirectional Printer Carriage," Darwin et al., vol. 15, No. 1, Jun. 1972, p. 151.

IBM Technical Disclosure Bulletin, "Detachable Printer Pin Feed," Kroeker, vol. 18, No. 11, Apr. 1976, p. 3536.

*Primary Examiner*—Ernest T. Wright, Jr.

*Attorney, Agent, or Firm*—Barry Paul Smith

[57] ABSTRACT

A record material feed apparatus for use with a printing machine of the type including a platen and drive means for rotating the platen about its longitudinal axis. The apparatus comprises a frame capable of being attached to a printing machine adjacent the platen thereof, first and second drive shafts each rotatably mounted on the frame, and first and second drive assemblies respectively mounted on the first and second drive shafts, each drive assembly including means for engaging a marginally punched record material loaded thereon and means for feeding said record material in response to the rotation of the respective drive shaft. Further, a drive assembly is mounted on the frame and includes means for engaging the platen drive means and means responsive to such engagement and the operation of the drive means for rotating the first and second drive shafts in opposite directions. In this manner, the first and second drive assemblies are capable of respectively advancing the marginally punched record material in said opposite directions.

7 Claims, 8 Drawing Figures

BI-DIRECTIONAL RECORD MATERIAL FEED APPARATUS

BACKGROUND OF THE INVENTION

This invention relates to apparatus capable of feeding marginally punched record material and, more particularly, to such an apparatus for use with a printing machine of the type comprising a platen and drive means for rotating the platen about its longitudinal axis.

When feeding marginally punched record material, such as computer forms paper, it is generally necessary to use a feeding apparatus different than the conventional platen-pressure roller arrangement, due to the thickness of the multi-copy paper and the use of periodic perforations for tearing purposes. The two most common feeding apparatus for this type of record material are the pin-feed apparatus and the tractor feed apparatus. An exemplary pin feed apparatus is disclosed in U.S. Pat. No. 4,033,493, whereas an exemplary tractor feed apparatus is disclosed in U.S. Pat. No. 4,042,091. In both the pin feed apparatus and the tractor feed apparatus, the platen pressure rollers must necessarily be disengaged during feeding by such apparatus. U.S. Pat. No. 4,042,091 discloses a novel manner by which this may be done automatically through movement of a guide rack included in the feed apparatus.

Very recently, it has become necessary to provide a record material feed apparatus with a bi-directional feeding capability. This is especially true when computer forms paper is used to print graphical data and the like. A pin feed apparatus having a bi-directional feeding capability is disclosed in U.S. Pat. No. 4,033,493. One problem with pin feed apparatus, however, is that the pin wheels are usually mounted on the platen drive shaft at the opposing ends of the platen. Thus, the size of the record material is normally restricted to a width substantially coincident with the length of the platen.

Tractor feed apparatus of the type disclosed in U.S. Pat. No. 4,042,091 avoid the above problem through the use of a pair of tractor feed assemblies slidably mounted on a pair of shafts adjacent to the platen. The slidability of these assemblies insures that virtually any sized record material up to the length of the platen itself can be employed. Tractor feed apparatus traditionally employ tractor feed assemblies of the above type each of which employes a continuous belt driven by pins projecting from the belt surface. The belt is driven by a single sprocket wheel mounted on one of the shafts to which the tractor feed assembly is slidably mounted.

In prior art bi-directional tractor feed apparatus using such tractor feed assemblies, one flat belt side is used to pull record material through the printer in one direction, and the other side of the same belt is used to pull it in the reverse direction. Loading of the record material in such apparatus is generally awkward and often results in damage to the marginally punched holes on the record material. It also usually requires either blind loading of the paper or requires that the apparatus be swivelable forwards to expose the reverse feeding side of the belt for loading. Additionally, sometimes the record material falls off the rear side of the tractor assemblies, if not properly supported, during operation. As another disadvantage, since the belt of each tractor assembly is driven by a single sprocket wheel, by a single shaft, and by one pair of drive gears, as is conventional, any free play in this extended mechanism results in a print position discrepancy between information printed after two different directions of drive.

It would be desirable, therefore, to provide a bi-directional record material feed apparatus that is easy to load with record material without pivoting the entire apparatus, and that can be reliably reversed in direction without adversly affecting print position alignment. It would further be desirable if such feed apparatus were of a type that does not restrict the size of record material to be fed, such as in the case of contempary tractor feed apparatus.

SUMMARY OF THE INVENTION

In accordance with the present invention, a record material feed apparatus is provided for use with a printing machine of the type including a platen and drive means for rotating said platen about its longitudinal axis. The apparatus comprises a frame capable of being attached to a printing machine adjacent the platen thereof; first and second drive shafts each rotatably mounted on said frame; first and second drive assemblies respectively mounted on said first and second drive shafts, each drive assembly including means for engaging a marginally punched record material loaded thereon and means for feeding said record material in response to the rotation of the respective drive shaft; and a drive assembly mounted on said frame and including means for engaging the platen drive means of a printing machine and means responsive to such engagement and the operation of said drive means for rotating said first and second drive shafts in opposite directions, whereby said first and second drive assemblies are capable of respectively advancing said marginally punched record material in opposite directions.

In accordance with the preferred embodiment, the first drive assembly includes a conventional tractor feed assembly including a continuous belt having projecting pins, the belt being driven by a sprocket wheel mounted on the first drive shaft. There are preferably two such tractor feed assemblies which are slidably mounted on the first drive shaft and a stationary shaft connected to the support frame. The pair of tractor feed assemblies are primarily responsible for advancing the record material in a foward direction (upwardly relative to the print location on the platen surface).

Also in accordance with the preferred embodiment, the second drive assembly includes a sprocket drive wheel mounted on the second drive shaft and having spaced pins projecting about its periphery for engaging the marginally punched holes of the record material. As with the tractor feed assemblies, there are preferably two such sprocket drive wheels which are slidably mounted on the second drive shaft. The pair of sprocket drive wheels are responsible for facilitating loading of the record material into the printer and around the platen, as well as for advancing the record material once loaded in a rearward direction (downwardly relative to the print location on the platen surface).

Still further in accordance with the preferred embodiment, the drive assembly includes a gear train having a main idler gear engagable with a gear of the platen drive means and a pair of gears respectively connected to the first and second drive shafts. The idler gear, as is conventional, is made adjustable in directions along the line of centers of the idler gear and the platen drive gear. The remaining gears of the gear train, including the pair above-mentioned, form a closed loop with the main idler gear wherein all but one of these remaining gears are fixed. The non-fixed remaining gear is adjustable in a direction normal to the line of centers of such gear and the main idler gear. Thus, after the main idler gear is adjusted relative to the platen drive gear to eliminate so-called "backlash", or play therebetween, then only the nonfixed gear need be adjusted to virtually eliminate all remaining backlash in the entire gear train, thereby insuring reliably aligned printing on bi-directionally movable record-material.

These and other aspects and advantages of the invention will be described below with reference to the to the accompanying drawing.

DESCRIPTION OF THE PREFERRED EMBODIMENT

Figure 1:
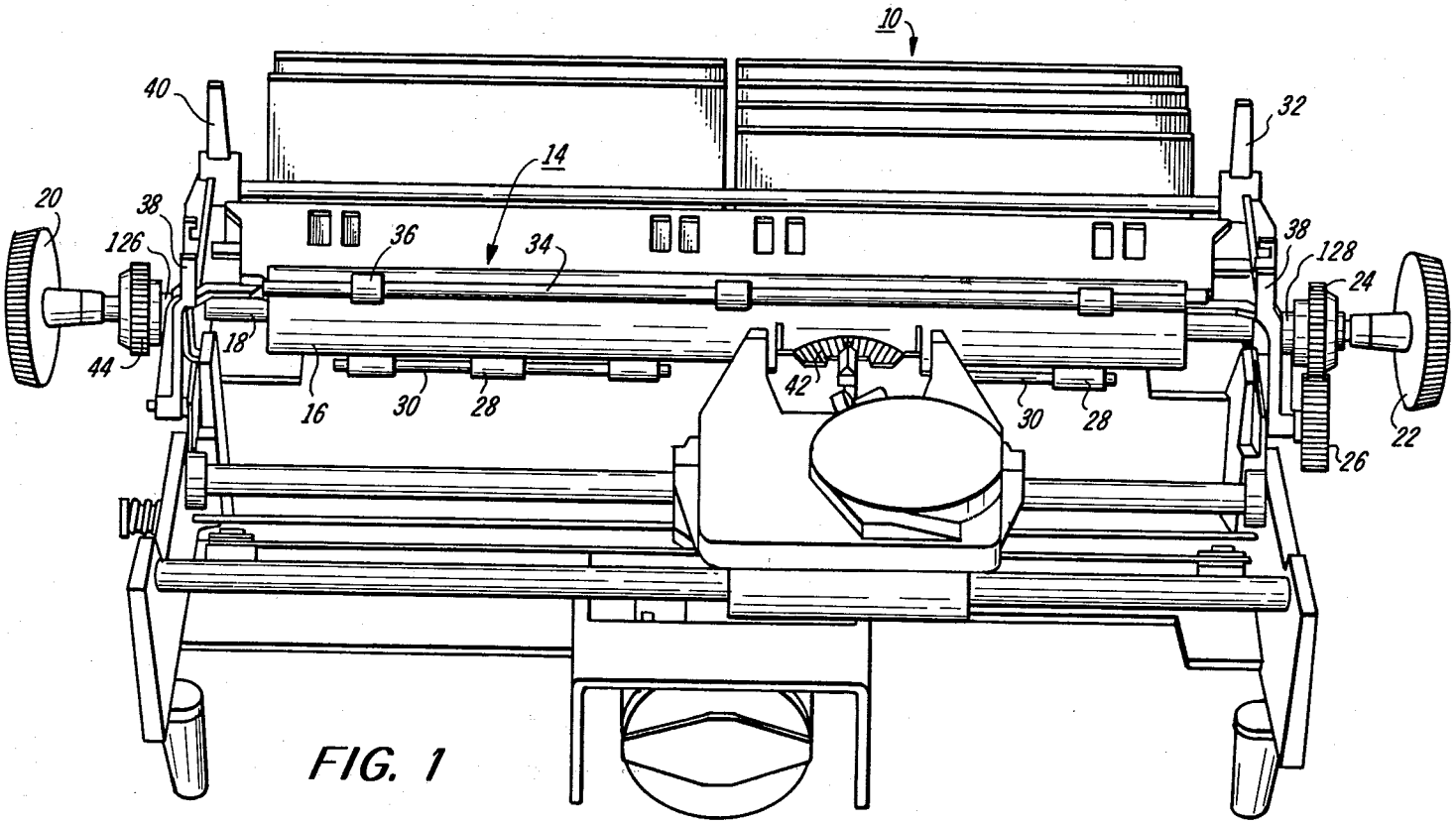
FIG. 1 is a front perspective view of a printing machine with which a record material feed apparatus of the present invention may be used.

Referring to FIG. 1, an exemplary printing machine (printer) 10 is shown with which a record material feed apparatus 12 (FIGS. 2–8) of the present invention may be employed. The printer 10 preferably includes a conventional platen feed assembly 14 which includes a platen 16 mounted on a rotatable shaft 18 for rotation therewith. Mounted at each end of the shaft 18 are a pair of knobs 20 and 22 for enabling the manual rotation of the shaft 18 and platen 16. As is conventional, the knob 20 is fixed relative to the shaft 18 and the knob 22 is movable axially of the shaft 18 between first and second positions. When in a first position, a gear-drive assembly 24 mounted about the shaft 18 adjacent the knob 22 is engaged with the shaft 18 so that a motor-gear arrangement 26 (only partly shown) coupled to the gear-drive assembly 24 controls the automatic rotation of the shaft 18. When in a second position, the knob 22 disengages the gear-drive assembly 24 from the shaft 18 so that manual rotation of the knobs 20 and 22 will cause a corresponding rotation of the shaft 18 and platen 16.

The platen feed assembly 14 also comprises a plurality of pressure rollers 28 connected to one or more lower bail bars 30. By way of example, four bail bars 30 are employed (only the front two visible in FIG. 1), each bail bar 30 having three rollers 28 rotatably mounted thereon. As is conventional in serial printers and typewriters, a spring-biased lever 32 is included in the printer 10 for manual movement between a first or rearward position and a second or forward position. Conventional linkage means (not shown) is coupled between the lever 32 and the bail bars 30 and cooperates with conventional biasing springs (not shown) for maintaining the rollers 28 in pressure engagement with the platen 16 when the lever 32 is at its first position and for retracting and holding the rollers 28 a predetermined distance from the platen 16 when the lever 32 is moved to its second position.

The platen feed assembly 14 further includes an upper bail bar 34 having a plurality, e.g., three, follower rollers 36 rotatably mounted thereon. These rollers 36, when engaged with the platen 16, serve to hold the record material 70 on the platen 16 so that it is directed from the printer 10 in a generally rearward direction, as is conventional. Conventional spring-biased levers 38 are connected to the printer 10 and to the bail bar 34 for maintaining the rollers 36 in pressure engagement with the platen 16 when the levers 38 are in a first or rearward position, and for removing and holding the bail bar 34 and thus rollers 36 a predetermined distance forwardly of the platen 16 when the levers 38 are moved to a second or forward position.

The platen feed assembly 14 also preferably includes a lever 40 connected to the printer 10 and capable of being manually positioned at a number of detent positions corresponding to desired distances of the platen 16 from a print member 42 mounted adjacent the platen 16. Appropriate and conventional linkage and mounting means (not shown) coupled between the lever 40 and the platen 16 achieves the desired shifting of the platen 16 in response to movement of the lever 40.

The platen feed assembly 14 additionally includes a gear assembly 44 fixed to the shaft 18 preferably adjacent the knob 20. The gear assembly 44 is thus rotatable along with the shaft 18 and, as will be described in more detail below, couples motor-drive power as applied to the shaft 18 through the motor-gear arrangement 26 and the gear-drive assembly 24, to the record material feed apparatus 12 and is mounted on the printer 10 in a manner to be described below.

Further details of the platen feed assembly 14 and the exemplary printer 10 may be obtained through a review of the HyType II serial printer manufactured by Diablo Systems, Inc. (a Xerox Company) of Hayward, California.

Figure 3:
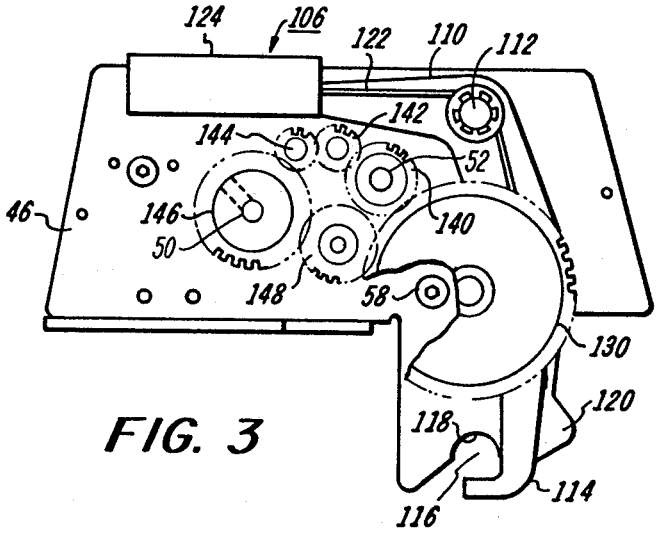
FIG. 3 is a cross-sectional view of the record material feed apparatus of FIG. 2 taken along line 3—3 of FIG. 2.
Figure 4:
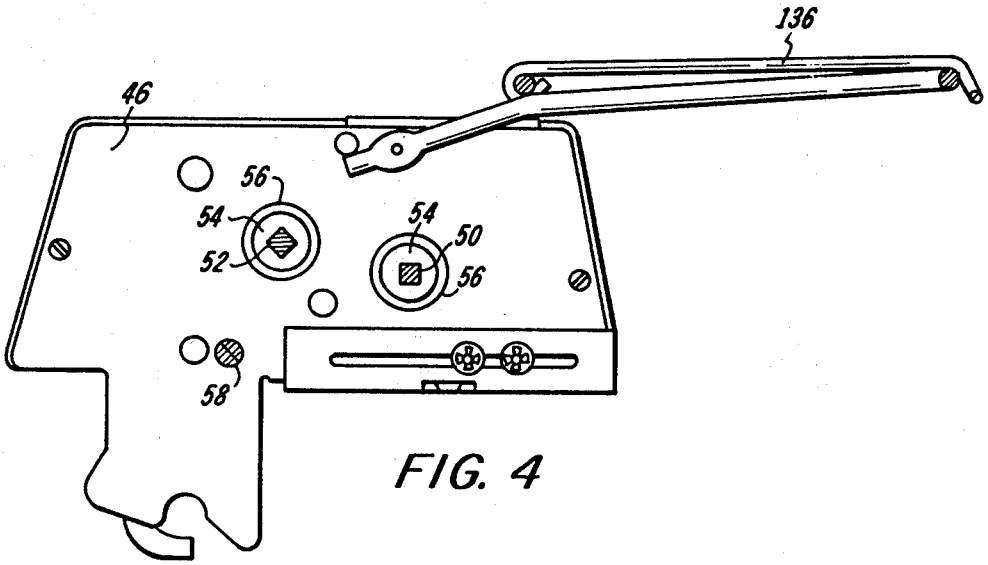
FIG. 4 is another cross-sectional view of the record material feed apparatus of FIG. 2 taken along line 4—4 of FIG. 2.

The record material feed apparatus 12 of the invention will now be described with reference to FIGS. 2–8. As shown, the apparatus 12 includes a main frame comprised primarily of a pair of opposing parallel plates 46 and 48 spaced a predetermined distance apart. Rotatably mounted between the plates 46 and 48 are a pair of drive shafts 50 and 52. The ends of the shafts 50 and 52 are mounted through suitable bearing members 54 (FIG. 4) disposed in respective openings 56 in each plate 46 and 48 (only the bearings 54 disposed in the openings 56 of plate 46 are shown in FIG. 4, however identical such bearings 54 and openings 56 appear in plate 48). The manner in which shafts 50 and 52 are rotated will be described below.

A third shaft 58 is mounted between the plates 46 and 48. This shaft 58 is fixed in position and cannot rotate. A pair of drive assemblies 60 and 62 are slidably mounted on the shafts 52 and 58. The drive assemblies 60 and 62 are preferably constituted by left and right hand tractor feed assemblies which may be of conventional variety, such as the type disclosed in U.S. Pat. No. 4,042,091.

Figure 8:
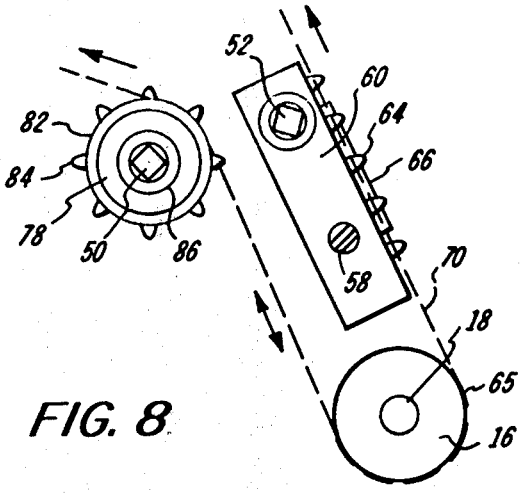
FIG. 8 depicts the paper path relative to the sprocket drive assemblies, the tractor feed assemblies and the printer platen.

As best shown in FIG. 8, each tractor feed assembly 60 and 62 includes a plurality of pins 64 supported or formed on a continuous loop drive belt 66. As is conventional, each belt 66 is supported about a pair of hubs (not shown). One of the hubs is a drive hub mounted about the shaft 52 and the other hub is an idler hub mounted about the fixed shaft 58. Each tractor feed assembly 60 and 62 further includes a conventional clamp assembly 68 for enabling the tractor feed assemblies 60 to be selectively adjusted in linear position along the shafts 52 and 58 dependent upon tthe width of the record material 70 to be fed thereby. Each tractor feed assembly 60 and 62 has a spring loaded front door, i.e., left-hinged door 72 for assembly 60 and right-hinged door 74 for assembly 62. Each door 72 and 74 is pivotal from a closed position as shown to an open position (not shown). In the opened position, a marginally punched record material 70 (FIG. 8) can be loaded onto the tractor feed assemblies 60 and 62 by engaging the marginally punched holes thereof with the pins 64 in a known manner.

A principal purpose of the tractor feed assemblies 60 and 62 is to engage with their pins 64 to marginally punched holes of a record material 70, such as computer forms paper, and positively drive such record material 70 in a forward direction, i.e., upwardly relative to a printing position 65 on the platen 16, as shown in FIG. 8. When the record material 70 is driven in a reverse direction in a manner to be described below, the tractor feed assemblies 60 and 62 serve to guide the record material 70 and to maintain it in tension.

Also slidably mounted on the shafts 52 and 58 are a pair of identical record material guide bars 76. The bars 76 are adjustable along the length of the shafts 52 and 58 and serve to prevent the record material 70 from buckling or getting caught between the shafts 52 and 58.

In accordance with a unique aspect of the invention, another pair of drive assemblies 78 and 80 are slidably mounted on the other drive shaft 50. The drive assemblies 78 and 80 are preferably constituted by a pair of sprocket or pin wheel assemblies. Each pin wheel assembly 78 and 80 includes a pin wheel 82 ad 83, respectively, each having a plurality of spaced pins 84 about its periphery. Each pin wheel 82 and 83 is mounted about the shaft 50 by a suitable bearing assembly 86. A mounting bracket 88 is connected by suitable means between the pin wheel assembly 78 and the tractor feed assembly 60 for maintaining the pins 84 of the pin wheel assembly 78 in alignment with the pins 64 of the tractor feed assembly 60. Likewise, a similar mounting bracket 90 is connected by suitable means between the pin wheel assembly 80 and the tractor feed assembly 62 for maintaining the respective pins 84 and 64 thereof in alignment. By "alignment", it is meant that the pins 84 and 64 of adjacent pin wheel and tractor feed assemblies 80 and 62 intersect a common plane perpendicular to the axes of the shafts 50, 52 and 58 (see FIG. 2).

Figure 2:
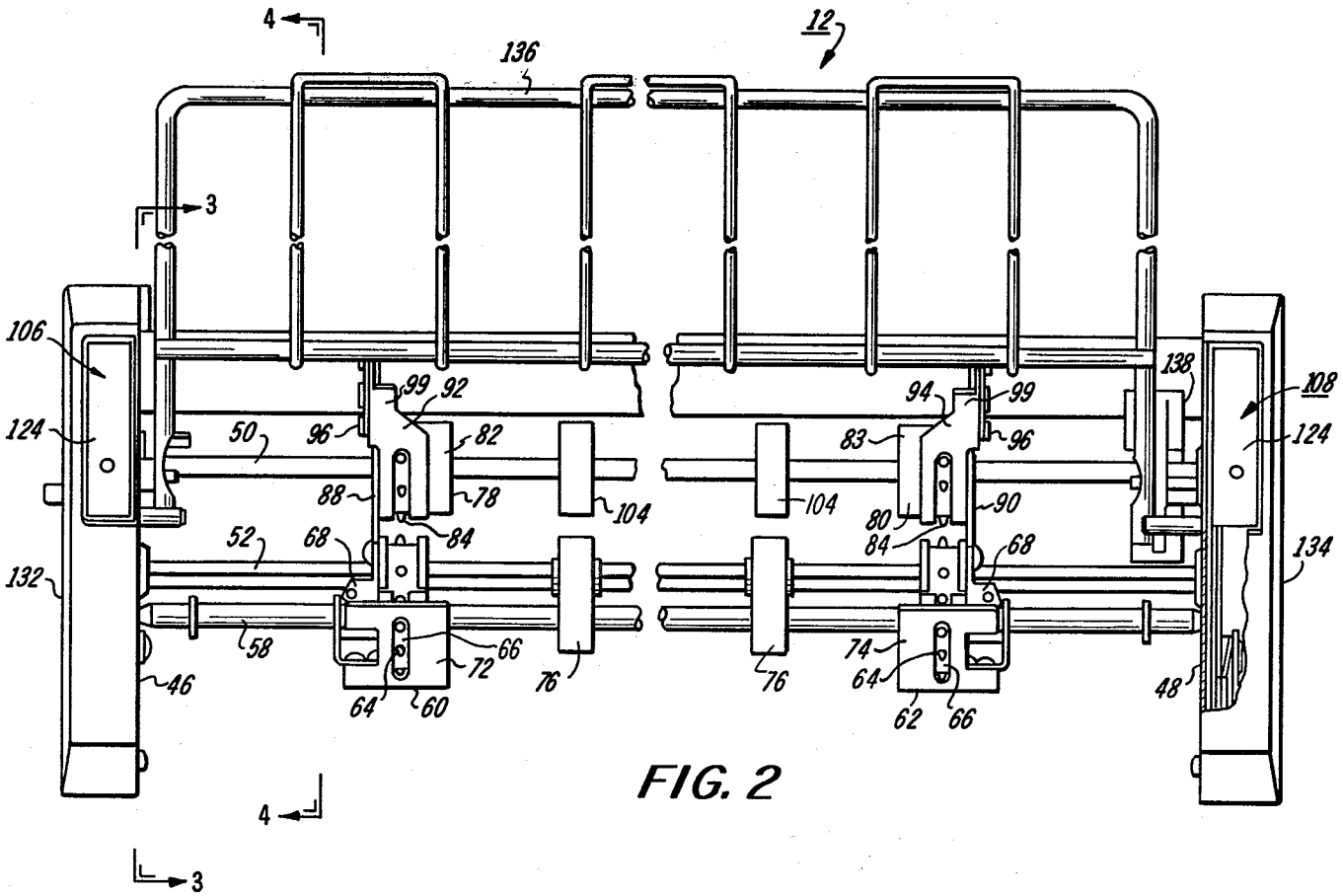
FIG. 2 is a fragmentary top plan view of a record material feed apparatus of the present invention.
Figure 6:
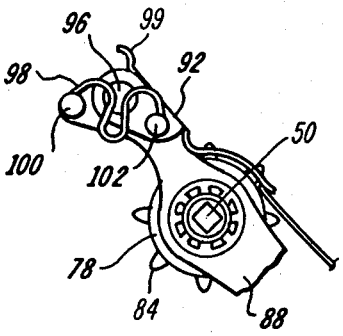
FIG. 6 is a side elevational view of one of the sprocket drive assemblies used in the record material feed apparatus of FIG. 2.
Figure 7:
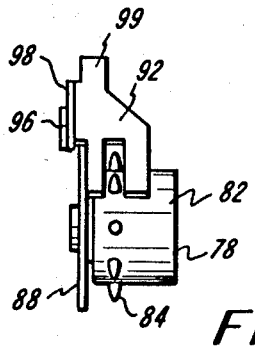
FIG. 7 is a front elevational view of the sprocket drive assembly shown in FIG. 6.

Referring to FIGS. 2, 6 and 7, each pin wheel assembly 78 and 80 further comprises a spring clip assembly 92 and 94, respectively. Each spring clip assembly 92 and 94 is pivotally mounted about a pin 96 located in the respective mounting bracket 88 and 90. A spring 98 is also mounted on each mounting bracket 88 and 90 with its ends secured to a pair of pins 100 and 102 formed on the mounting bracket 88 and 90. In this manner, each spring clip assembly 92 and 94 is biased in a closed position to maintain the assembly 92, 94 shut (as shown in FIGS. 2, 6 and 7), and can also be manually opened by depressing a lip portion 99 of each assembly 92 and 94 so that they pivot about the pins 96. When fully opened, the spring 98 acts to maintain it opened. These types of springs 98 and spring clip assemblies 92 and 94 are well known in the art.

A primary purpose of the pin wheel assemblies 78 and 80 is to greately facilitate loading marginally punched record material 70 into a printer 10 and onto the tractor feed assemblies 60 and 62. More specifically, when the record material feed apparatus 12 is attached to the printer 10 in a manner to be described below, marginally punched record material 70 is first loaded onto the pins 84 of the pin wheel assemblies 78 and 80 by opening the spring clip assemblies 92 and 94, and then, after the assemblies 92 and 94 are closed, advancing the record material 70 in a forward direction around the platen 16 and upward onto the tractor feed assemblies 60 and 62, whose doors 72 and 74 would then be opened to load the record material 70 onto the pins 64 (see FIG. 8).

Another purpose of the pin wheel assemblies 78 and 80 is to positively drive the record material 70 in a rearward direction as shown in FIG. 8. Additionally, during forward feeding following loading, the pin wheel assemblies 78 and 80 serve to guide the record material 70 into the printer 10, as well as maintaining it in tension.

A pair of identical guide wheels 104 (FIG. 2) are also slidably mounted on the shaft 50 by suitable means (not shown). The guide wheels 104 are restrained from rotational motion relative to the shaft 50 and are slidably adjustable along the length of the shaft 50. The guide wheels 104 serve to prevent the record material 70 from buckling and getting caught between the various shafts 50 and 52.

Before describing the preferred means for driving the driven shafts 50 and 52, certain other features of the record material feed apparatus 12 will be discussed. Referring to FIGS. 2 and 3, connected to the exterior surface of each plate 46 and 48 of the main frame is a clamp assembly 106 and 108, respectively. As best shown in FIG. 3, each clamp assembly 106 and 108 includes a generally L-shaped pivot member 110 mounted near its center about a pivot pin 112. Each pivot member 110 has a hook 114 at its lower end which forms an opening 116 with a recess 118 formed in a downwardly projecting flange portion 120 of the corresponding plate 46 or 48 when the pivot member 110 is in a first position as shown in FIG. 3. The pivot members 110 are normally biased in their first positions by respective spring members 122 mounted thereon. A push-bar 124 forming part of each pivot member 110 projects therefrom slightly above the upper surface of the corresponding plate 46 or 48 (see FIG. 3). Each push-bar 124 can be depressed to pivot the respective pivot member 110 counterclockwise as shown in FIG. 3 to move the hook 114 clear of the opening 116. When so moved, the record material feed apparatus 12 can be mounted on the printer 10 by engaging the shaft 18 (FIG. 1) in the openings 116 of each frame plate 46 and 48 and then releasing the bar 124 to restore the hooks 114 to the position shown in FIG. 3 thereby locking the plates 46 and 48 about the bearings 126 and 128 mounted on the shaft 18 (FIG. 1). Of course, such locking does not inhibit the free rotation of the shaft 18.

The location along the shaft 18 at which the record material feed apparatus 12 is mounted is defined by the location of the bearings 126 and 128. In this manner, the platen drive gear assembly 44 will engage a main idler gear 130 (FIGS. 3 and 5) forming part of the drive apparatus for the record material feed apparatus 12 and to be described below.

Mounted on each plate 46 and 48 of the main frame are a pair of complementary housings 132 and 134 (FIG. 2). These housings 132 and 134 serve primarily to shield the various mechanisms mounted on the outer surface of the respective frame plates 46 and 48, as well as to enhance the asthetic appearance of the record material feed apparatus 12.

Referring to FIGS. 2 and 3, a guide rack 136 of the type disclosed in U.S. Pat. No. 4,042,091 is pivotally mounted between the frame plates 46 and 48. In the position shown in FIG. 4, the rack 136 serves to guide the egress off record material 70 from the printer 10. Also, in that position, it cooperates with an interlock member 138 to control the position of lever 32 of the printer 10 (FIG. 1) to maintain the rollers 28 of the bail bars 30 disengaged from the platen 16, thereby allowing unobstructed use of the record material feed apparatus 12. The guide rack 136 may be raised to facilitate the loading of record material 70 into the printer 10. In this position, and as described in U.S. Pat. No. 4,042,091, the interlock member 138 is pivoted to move the lever 32 to a position where the rollers 28 of the bail bars 30 are re-engaged with the platen 16.

Figure 5:
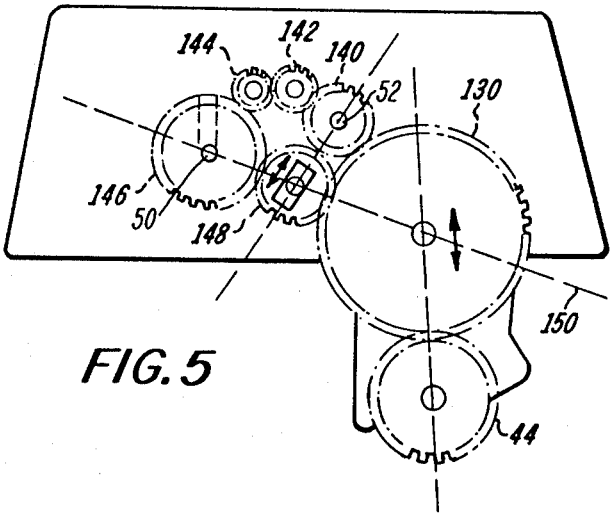
FIG. 5 is an elevational view of the left side of the record material feed apparatus of FIG. 2 with certain components deleted for clarity of others.

Reference is now had to FIGS. 3 and 5 where a presently preferred drive assembly for the drive shafts 50 and 52 will be described. As shown, the drive assembly is preferably constituted by a gear train comprised of six gears 130, 140, 142, 144, 146 and 148, where gears 130, 142, 144 and 148 are rotatably mounted on the outer surface of the frame plate 46, and gears 140 and 146 are respectively connected to the left ends of the drive shafts 52 and 50. The gears 130 and 148 are preferably adjustable in a manner and for a purpose to be described below. The main idler gear 130, as indicated above, is engaged with the platen drive assembly gear 44 when the record material feed apparatus 12 is connected to the printer 10. As is conventional, the main idler gear 130 is mounted on the plate 46 by suitable means (not shown) that enables both the free rotation of the gear 130 about its axis and adjustment along the "line of centers" of the gears 44 and 130. As used herein, the term "line of centers" shall be deemed to mean a line intersecting and normal to the axes of rotation of the gears 44 and 130. The purpose of this adjustment is to eliminate any backlash existing between the two gears 44 and 130.

The gears 140 and 148 of the six gear train are engaged with the main idler gear 130 for rotation in the opposite direction hereto. The gear 140 is a drive gear and is attached to the left end of the drive shaft 52 for driving the tractor feed assemblies 60 and 62. The gear 148 is an idler gear that is rotatably mounted on the plate 46 and is preferably also adjustable to reduce backlash in a manner to be described below.

Engaged with the drive gear 140 is the gear 142, which is an idler gear rotatably mounted on the plate 46 by suitable means, and engaged with the idler gear 142 is the gear 144, which is another idler gear also rotatably mounted on the plate 46. The gear 146, which is a drive gear, is attached to the left end of the drive shaft 50 for driving the pin wheel assemblies 78 and 80 in a direction opposite to the direction of drive of tractor feed assemblies 60 and 62 by the drive gear 140. The idler gear 148 is engaged with the drive gear 146, as well as the main idler gear 130.

Referring to FIG. 5, it will be noted that the gears 146, 148 and 130 have their centers aligned, i.e., an imaginary line 150 can be drawn normal to and intersecting to the axes of rotation of these gears 146, 148 and 150. In accordance with the presently preferred embodiment, only idler gear 148 of the group of five gears 140, 142, 144, 146 and 148 is made adjustable to overcome backlash. The other four of these gears (is 140, 142, 144 and 146) are fixed. The gear 148 is adjusted in a direction perpendicular to the imaginary "line of centers" 150 to remove backlash. Preferably, it is adjusted upward an amount equal to ½ of the backlash to be eliminated. As this motion is very slight, the mesh between gears 146, 148 and 130 is not adversly affected. The adjustment of gear 148 may be made with the record material feed apparatus 12 fully assembled.

For mass production purposes, it is normally the practice to design the entire gear train (gears 130 and 140–148) with fairly liberal backlash between adjacent gear pairs. In accordance with the invention, therefore, first the main idler gear 130 is adjusted relative to the platen drive gear 44 to eliminate any backlash relative thereto. Then, substantially all remaining backlash existing in the entire gear train may be eliminated simply by adjusting one gear of such train, preferably idler gear 148 in the manner above-described. This is made possible since the six gears 130, 140, 142, 144, 146 and 148 of the gear train form a closed loop. It is to be again noted that the desired direction of adjustment of gear 148 is upward as shown in FIG. 5.

In operation, record material 70 (FIG. 8) may be quickly and easily loaded onto the record material feed apparatus 12 and through the printer 10 without having to pivot the entire apparatus. Such operation is as follows. First, the levers 38 are pulled forwardly to disengage the rollers 36 of bail bar 34 from the platen 16. Second, the spring clip assemblies 92 and 94 are depressed at their lip portions 99, thereby causing them to pivot and exposing the underlying pins 84. Third, the record material 70 is loaded onto these pins 84 and the spring clip assemblies 92 and 94 snapped shut. Fourth, the guide rack 136 is pivoted forwardly and upwardly to facilitate loading the record material 70 onto the printer 10 and to engage the rollers 28 of the bail bars 30 against the platen 16. Fifth, the record material 70 is advanced by manual movement of the platen 16 between the nip between the bail bar rollers 28 and the platen 16. Sixth, when the record material 70 comes around the front of the platen 16 and upward, the guide rack 136 is returned to its guide position shown in FIG. 4, thereby disengaging the bail bar rollers 28 from the platen 16. Seventh, the doors 72 and 76 of the tractor feed assemblies 60 and 62 are opened and the record material 70 is loaded onto the pins 64 thereof. Eighth, the doors 72 and 76 are closed. Ninth, the rack 136 is returned to its original position which disengages the rollers 28 from the platen 16. Tenth, the levers 38 are pushed back to their original positions to bias the record material 70 against the platen 16. The record material feed apparatus 12 is then ready for automatic bi-directional feeding of the record material 70 wherein, as indicated above, the tractor feed assemblies 60 and 62 are primarily responsible for forward feeding and the pin wheel assemblies 78 and 80 are primarily responsible for reverse feeding.

Although the invention has been described with respect to a presently preferred embodiment, it will be appreciated by those skilled in the art that various modifications, substitutions, etc. may be made without departing from the spirit and scope of the invention as defined in and by the following claims.

By way of example only, the final backlash adjustment using the gear 148 is only exemplary. If desired, either of the other two idler gears, i.e., gears 142 and 144, could be made adjustable. What is important in this respect is that, other than the main idler gear 130, only one of the remaining idler gears 142 and 144 should be adjustable for final backlash removal. Further, the idler gear 142 or 144 to be so adjusted should preferably be in line of centers alignment with the main idler gear 130 and any intermediary gears. Thus, for example, if gear 142 were to be the adjustable anti-backlash gear, and gears 140, 144, 146 and 148 were all fixed, then gear 142 should normally be on line of center with gears 140 and 130 (a condition not shown in FIG. 5). Then, the preferred adjustment of gear 142 would be upward perpendicular to such line of centers. Additionally, whichever of gears 148, 142 and 144 is used as the adjustable gear, it may be urged in the appropriate direction (148-upwards, 142-upwards, and 144-downwards) to remove backlash by a spring (not shown). The purpose of these directions of biasing is to facilitate the shortest possible power train. The use of a spring to achieve such biasing has the additional advantage of removing backlash due to gear eccentricities throughout the train, as well as constant gear backlash. The choice of the particular gear to be selected as the adjustable gear is preferably one not in either the forward feeding gear power train or the reverse feeding gear power train; namely, either gears 142 or 144 in the embodiment of FIGS. 3 and 5.

As another example, the use of a pair of pin wheel assemblies 78 and 80 driven by the shaft 50 and a pair of tractor feed assemblies 60 and 62 driven by the shaft 52, although presently preferred, is not essential. Alternatively, a second pair of tractor feed assemblies could be used driven by the shaft 50, or a second pair of pin wheel assemblies could be used driven by the shaft 52, or the shafts 50 and 52 could drive a pair of tractor feed assemblies and a pair of pin wheel assemblies, respectively. Further, the power path defined along the tractor feed assemblies 60 and 62 can be arcuate in shape, instead of flat as shown in FIG. 8.

What is claimed is:

1. A record material feed apparatus for use with a printing machine of the type including a platen and drive means for rotating said platen about its longitudinal axis, said apparatus comprising:

a frame capable of being attached to said printing machine adjacent the platen thereof;

first and second drive shafts each rotatably mounted on said frame;

first and second drive assemblies respectively mounted on said first and second drive shafts, each drive assembly including means for engaging a marginally punched record material loaded thereon and means for feeding said record material in response to the rotation of the respective drive shaft, said first drive assembly comprising at least one pin wheel feeding assembly and said second drive assembly comprising at least one tractor feed assembly; and a third drive assembly mounted to said frame and including means for engaging the platen drive means of said printing machine and means responsive to such engagement and the operation of said drive means for selectively rotating said first and second drive shafts in predetermined rotational directions, whereby said first and second drive assemblies are capable of respectively advancing said marginally punched record material in opposite directions, said third drive assembly comprising a gear train including a plurality of gears arranged in a closed loop, said plurality of gears including a first gear engageable with the drive means of said printing machine, a second gear mounted on said first drive shaft for driving said first drive shaft, a third gear mounted on said second drive shaft for driving said second drive shaft, and a fourth idler gear engaged between said first and second gears such that said first, second and fourth gears are aligned along their line of centers, said first and fourth gears being adjustable relative to said line of centers.

2. The record material feed apparatus of claim 1, wherein said first drive assembly comprises a pair of pin wheel feeding assemblies disposed adjacent opposing ends of said first drive shaft and being adjustable along the length of said first drive shaft.

3. The record material feed apparatus of claim 2, wherein said second drive assembly comprises a pair of tractor feed assemblies disposed adjacent opposing ends of said second drive shaft and being adjustable along the length of said second drive shaft.

4. The record material feed apparatus of claim 1, wherein said gear train comprises a fifth gear engaged with said third gear and a sixth gear engaged with and between said fifth gear and said second gear, said fifth and sixth gears being idler gears.

5. The record material feed apparatus of claim 4, wherein said first gear is adjustable in position relative to the drive means of said printing machine.

6. The record material feed apparatus of claim 5, wherein said fourth idler gear is biased in a predetermined direction defining the direction of adjustment.

7. The record material feed apparatus of claim 5 or claim 6, wherein said fourth gear is adjustable in a direction perpendicular to said line of centers.

* * * * *